US006381305B1

(12) United States Patent
Okada et al.

(10) Patent No.: US 6,381,305 B1
(45) Date of Patent: Apr. 30, 2002

(54) X-RAY TUBE HAVING A HOOD ELECTRODE

(75) Inventors: Tomoyuki Okada; Masuo Ito; Kimitsugu Nakamura; Yoshitoshi Ishihara; Tsutomu Nakamura; Tutomu Inazuru, all of Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 09/633,159

(22) Filed: Aug. 4, 2000

Related U.S. Application Data

(63) Continuation-in-part of application No. PCT/JJ99/00507, filed on Feb. 5, 1999.

(30) Foreign Application Priority Data

Feb. 6, 1998 (JP) ..... 10-025885

(51) Int. Cl.[7] ..... H01J 35/14
(52) U.S. Cl. ..... 378/137; 378/138; 378/140

(58) Field of Search ..... 378/137, 138, 378/140

(56) References Cited

U.S. PATENT DOCUMENTS

| | | | | |
|---|---|---|---|---|
| 5,077,771 A | 12/1991 | Skillicorn et al. | ..... | 378/102 |
| 5,563,923 A | 10/1996 | Okada et al. | ..... | 378/138 |

FOREIGN PATENT DOCUMENTS

| | | |
|---|---|---|
| GB | 1 220 423 | 1/1971 |
| JP | 7-296751 | 11/1995 |
| WO | WO 97/42646 | 11/1997 |

*Primary Examiner*—Robert H. Kim
*Assistant Examiner*—Allen C. Ho
(74) *Attorney, Agent, or Firm*—Morgan, Lewis & Bockius LLP

(57) ABSTRACT

A hood electrode attached to a tip portion of a target is provided with an electron passage port widening on the side opposite from an x-ray emitting window, so that electrons emitted from an electron gun are made incident on the front end face of a target at a position on the x-ray emission side, whereby the distance between the x-ray generating position and the x-ray emitting window can be shortened.

4 Claims, 12 Drawing Sheets

X-RAY TUBE HAVING A HOOD ELECTRODE

RELATED APPLICATION

The present application is a continuation-in-part application of PCT application No. PCT/JP99/00507 filed on Feb. 5, 1999, designating U.S.A. and now pending.

BACKGROUND OF THE INVENTION

1. Field of the Invention The present invention relates to an x-ray tube for generating x-rays.

2. Related Background Art

X-rays are electromagnetic waves for which most of materials and objects exhibit favorable transmitting properties, and are often used for nondestructive/noncontact observation of internal structures of objects. Usually, an x-ray tube is used for generating x-rays, and electrons emitted from an electron gun are caused to collide against a target, so as to generate x-rays. In general, for this collision, the center axis of a tubular member accommodating the electron gun therein and the center axis of a tubular member accommodating the target therein are aligned with each other, or their center axes are set perpendicular to each other.

As such x-ray tubes, those described in U.S. Pat. (USP) Nos. 5,077,771 and 5,563,923 have been known. FIG. 12 is a configurational view of an x-ray tube in which the center axis of a tubular member accommodating an electron gun therein and the center axis of a tubular member accommodating a target therein are substantially orthogonal to each other, the x-ray tube being disclosed in U.S. Pat. No. 5,077,771. As shown in FIG. 12, this x-ray tube comprises an electron gun portion 910 for generating/emitting electrons; and an x-ray generating portion 920 for receiving the electrons emitted from the electron gun portion 910, in which the electrons collide against a target 921, so as to generate x-rays.

Here, the electron gun portion 910 comprises a heater 911 for generating heat in response to an electric power supplied thereto from the outside; a cathode 912 for emitting electrons when heated by the heater 911; a focus grid electrode 913 for accelerating/converging the electrons emitted from the cathode 912; and a container 914 which accommodates the heater 911, cathode 912, and focus grid electrode 913 therein and has an electron passage port.

The x-ray generating portion 920 comprises the target 921 against which electrons emitted from the electron gun portion 910 collide, so as to generate x-rays; a hood electrode 922 formed like a flat tube enveloping the target 921 with its center axis being substantially orthogonal to the center axis of the electron gun portion 910, while having an electron passage opening in a path through which the electrons emitted from the electron gun portion 910 reach the target 921; a container 923 having an inner space for accommodating the target 921 and hood electrode 922 therein and having an opening for taking out the x-rays generated at the target 921, the inner space being connected to the inner space of the container 914 by way of the electron passage port of the container 914; and an x-ray takeout window 924 made of an x-ray transmitting member and disposed at the x-ray passage port of the container 923. A positive high voltage is applied to the hood electrode 922 and target 921 with reference to the potential at the emitting port of the electron gun portion 910.

In the x-ray tube of FIG. 12, the electrons emitted from the electron gun portion 910 are accelerated to a high speed by the electric field between the focus grid electrode 913 and the hood electrode 922, so as to advance in a vertical direction (i.e., electric field direction) of an equipotential surface at each position of the electrons at a given time, thereby colliding against the target 921 after passing through the electron passage opening of the hood electrode. When the electrons collide against the target 921, x-rays are generated, and the x-rays are outputted from the x-ray tube by way of the x-ray passage opening of the hood electrode 922 and x-ray passage window 924 in succession.

For quality control of parts and the like, x-ray tubes are used as an x-ray source in x-ray inspection apparatus for yielding magnified penetration images and the like. Also, capability of increasing the magnification rate is quite important in improving the accuracy of inspection.

FIG. 13 is a typical configurational view of such an x-ray inspection apparatus. In the x-ray inspection apparatus shown in FIG. 13, x-rays emitted from an x-ray tube 107 irradiate a sample on a sample dish 105. The x-rays transmitted through the sample are detected by an x-ray/fluorescence multiplier (an image intensifier tube: I.I. tube) 102, and a magnified penetration image is picked up by an image pickup tube 101. The magnification rate of the penetration image in this apparatus is determined by the ratio between the distance (A) from the x-ray generating point (the focal position of the x-ray tube) 106 within the x-ray tube to the sample position and the distance (B) from the sample position to the x-ray entrance surface of the I.I. tube. That is, the magnification rate M is expressed by $$M=(A+B)/A. \quad (1)$$

Normally, A<<B, and therefore the expression (1) can be represented by $$M=B/A. \quad (2)$$

Namely, for yielding a greater magnification rate, decreasing A or increasing B may be considered. Increasing B, however, not only enhances the overall size of the x-ray inspection apparatus, but also remarkably increases its weight by requiring a greater amount of lead shield 103 for keeping the x-rays from leaking outside, and so forth. Therefore, it is desirable that A be as small as possible.

SUMMARY OF THE INVENTION

Hence, in view of the foregoing, it is an object of the present invention to provide an x-ray tube which can shorten the distance from the x-ray generating point to the x-ray emitting window.

The present invention provides an x-ray tube comprising an electron gun for emitting an electron; a target for receiving the electron emitted from the electron gun at a front end face and generating an x-ray; an x-ray emitting window, disposed in front of the front end face of the target, for emitting the x-ray; and a hood electrode, formed as a tubular body attached to a tip portion of the target, having a peripheral face provided with an electron passage port for passing the electron therethrough, the electron passage port widening more on a side opposite from the x-ray emitting window than on the x-ray emitting window side with respect to a position intersecting an extension of the electron gun in an electron emitting direction. Also, the present invention provides an x-ray tube in which, of the tip portion of the target, a part exposed from the electron passage port is cutoff. Further, the present invention provides an x-ray tube in which the electron is made incident onto a center axis of the front end face of the target.

According to these aspects of the invention, the electron emitted from the electron gun pass through the electron passage port of the hood electrode and are made incident on the front end face of the target. Here, since the electron passage port is formed wider on the opposite side in the x-ray emitting direction, the electron is bent toward the x-ray emitting direction, so as to be made incident at a position near the x-ray emitting window. As a consequence, the distance between the x-ray generating position and the x-ray emitting window can be shortened.

Also, the present invention provides an x-ray tube comprising an electron gun for emitting an electron; a target for receiving the electron emitted from the electron gun In at a front end face and generating an x-ray; an x-ray emitting window, disposed in front of the front end face of the target, for emitting the x-ray; and a hood electrode formed as an annular body attached to a tip portion of the target, the hood electrode being disposed closer to the x-ray emitting window than is a position where the electron is made incident on the front end face.

According to this aspect of the invention, the electron emitted from the electron gun passes behind the hood electrode and is made incident on the front end face of the target. Here, since the electric field in the area where the electron passes is tilted toward the x-ray emitting window due to the existence of the hood electrode, the electron is bent toward the x-ray emitting direction, so as to be made incident at a position near the x-ray emitting window. As a consequence, the distance between the x-ray generating position and the x-ray emitting window can be shortened.

The present invention will be more fully understood from the detailed description given hereinbelow and the accompanying drawings, which are given byway of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
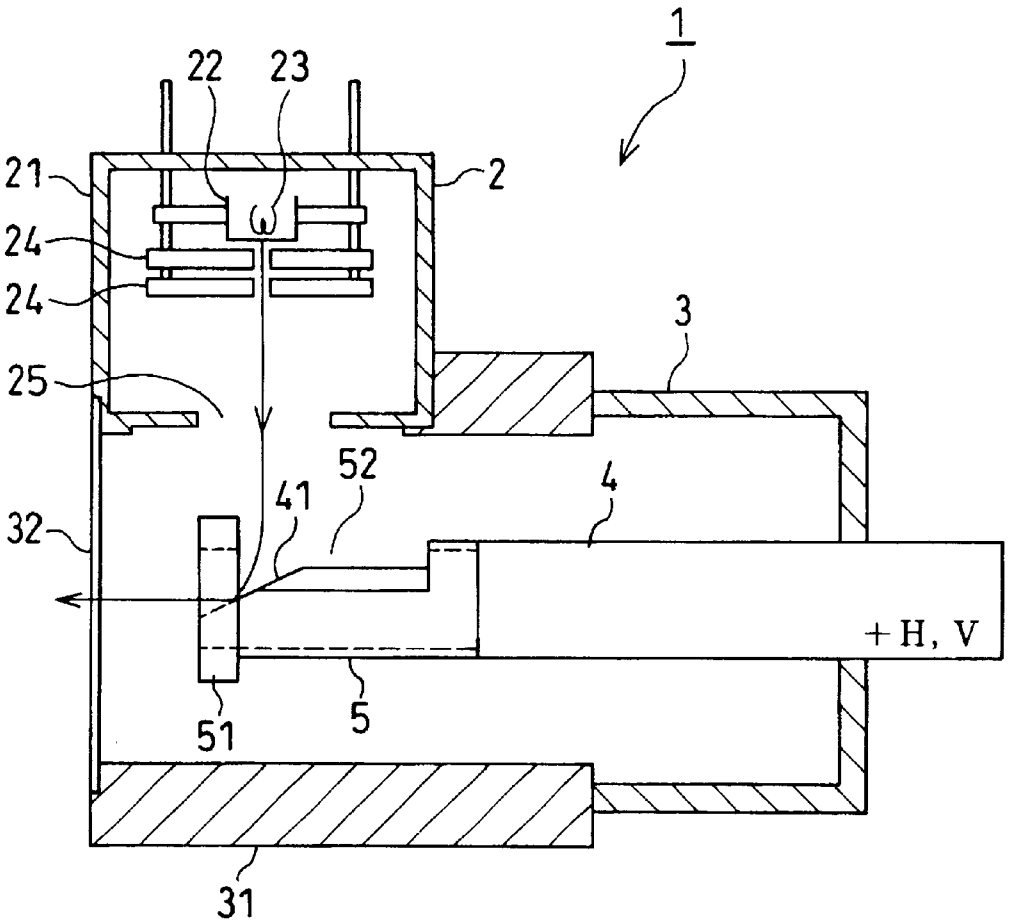
FIG. 1 is an explanatory view of the x-ray tube in accordance with a first embodiment of the present invention.

In the following, with reference to the accompanying drawings, embodiments of the present invention will be explained. Among the drawings, constituents identical to each other will be referred to with numerals identical to each other without repeating their overlapping descriptions. Also, ratios of dimensions in the drawings do not always coincide with those explained.

First Embodiment

Figure 2:
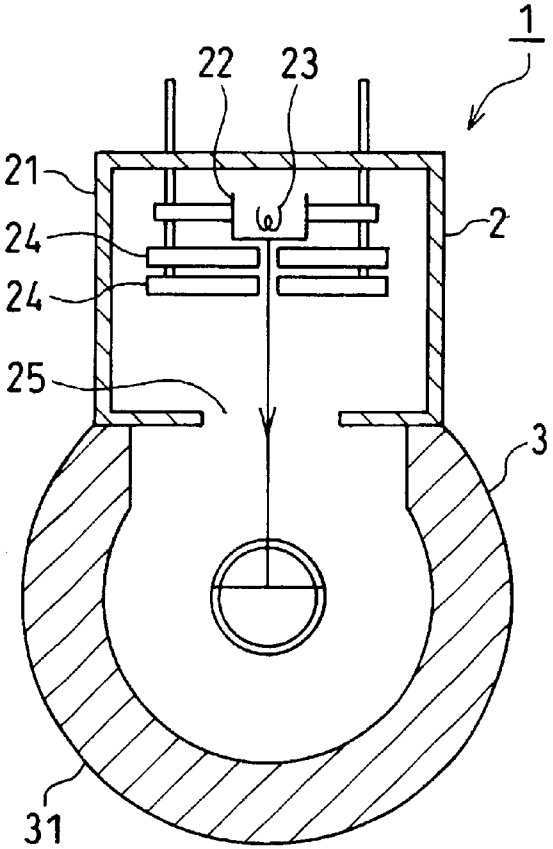
FIG. 2 is an explanatory view of the x-ray tube in accordance with the first embodiment of the present invention.

FIGS. 1 and 2 show an x-ray tube 1 in accordance with this embodiment. FIG. 1 is a lateral sectional view of the x-ray tube 1, whereas FIG. 2 is a longitudinal sectional view of the x-ray tube 1. As shown in FIG. 1, the x-ray tube 1 comprises an electron gun portion 2 for generating/emitting electrons, and an x-ray generating portion 3 for receiving the electrons from the electron gun portion 2 and generating x-rays.

The electron gun portion 2 is equipped with a container 21 for accommodating its individual components, whereas the container 21 is provided with a heater 22 which generates heat in response to an electric power supplied thereto from the outside. Also, the electron gun portion 2 is provided with a cathode 23 which emits electrons when heated by the heater 22. Also provided is a focus grid electrode 24 for converging the electrons emitted from the cathode 23. Further, the container 21 is provided with an opening 25 for emitting the electrons emitted from the cathode 23 and converged by the focus grid electrode 24. This opening 25 also functions as a focus electrode.

On the other hand, the x-ray generating portion 3 comprises a container 31 for accommodating its individual components. The container 31 communicates with the container 21 of the electron gun portion 2 by way of the opening 25, and has such a structure that the electrons emitted from the cathode 25 can enter. The containers 21, 31 are hermetically sealed, such that their inside is kept in a substantially vacuum state.

A target 4 is installed within the container 31. The target 4 receives the electrons from the electron gun portion 2 and generates x-rays. The target 4 is a rod-like body made of a metal, and is disposed in such an orientation that its axial direction intersects the direction in which the electrons advance. The front end face 41 of the target 4 is a surface for receiving the electrons from the electron gun portion 2, and is disposed at a front position where the electrons approach.

The container 31 is provided with an x-ray emitting window 32. The x-ray emitting window 32 is a window for emitting the x-rays generated from the target 4 to the outside of the container 31, and is constituted, for example, by a planar body made of a Be material which is an x-ray transmitting material. The x-ray emitting window 32 is disposed in front of the tip of the target 4. Also, the x-ray emitting window 32 is formed such that its center is positioned on an extension of the center axis of the target 4.

Attached to the tip portion of the target 4 is a hood electrode 5. The hood electrode 5 is used for causing the electrons to become incident on the front end face 41 of the target 4 at a position closer to the takeout side of x-rays, i.e., to the x-ray emitting window 32.

Also, with reference to the potential at the peripheral part of the opening 25 of the electron gun portion 2, a positive high voltage is applied to the hood electrode 5 and target 4.

Figure 3:
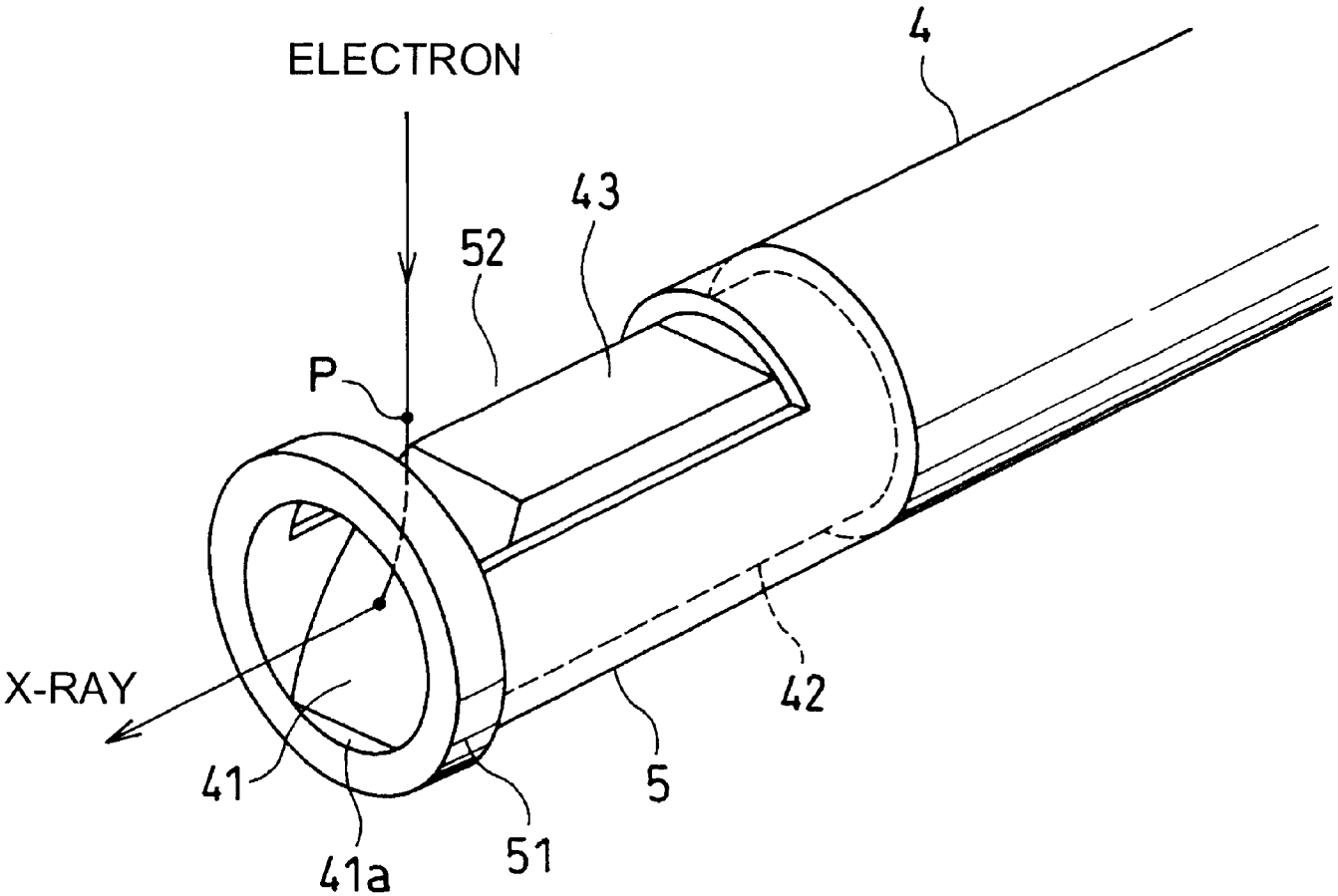
FIG. 3 is an explanatory view of a target and a hood electrode.

FIG. 3 shows an enlarged perspective view of the tip portion of target and the hood electrode.

As shown in FIG. 3, the tip portion 42 of the target 4 has a diameter smaller than that of the other portion. The front end face 41 of the tip portion 42 of the target 4 is formed oblique with respect to the axial direction of the target 4. Namely, the front end face 41 is formed so as to be neither orthogonal nor parallel to the axial direction of the target 4.

Attached to the tip portion 42 of the target 4 is the hood electrode 5. The hood electrode 5 is a tubular body made of a metal, whose inside diameter is substantially the same as the outside diameter of the tip portion 42 of the target 4. The length of the hood electrode 5 in its axial direction is substantially the same as the length of the tip portion 42 having a smaller diameter. The end part of the hood electrode 5 on the tip side thereof is formed with a greater diameter portion 51 whose thickness is increased like a ring. The greater diameter portion 51 is disposed at the forward end position of the front end face 41 of the target 4 when the hood electrode 5 is attached to the front end portion 42 of the target 4.

Also, the peripheral face of the hood electrode 5 is formed with an electron passage port 52. The electron passage port 52 is used for causing the electrons from the electron gun portion 2 (see FIG. 1) to become incident on the front end face 41 while the tip portion 42 of the target 4 is covered with the hood electrode 5. Therefore, the electron passage port 52 opens at a position where the electrons entering from the side portion of the target 4 can be made incident on at least the front end face 41.

Also, the electron passage port 52 is formed so as to widen more on the side opposite from the x-ray emitting window 32 than on the x-ray emitting window 32 side with respect to a position intersecting an extension of the electron gun portion 2 in the electron emitting direction. For example, the electron passage port 52 has an opening form widening on the side opposite from an electron passing position P in the x-ray emitting direction. As a consequence, abnormal discharge with respect to the container 31 and emitting window 32 is prevented from occurring.

Of the tip portion 42 of the target 4, the part exposed by the opening of the electron passage port 52 is cut substantially parallel to the axial direction, so as to form a flat face 43. The flat face 43 is formed in order to draw the electrons toward the x-ray emitting direction.

Also, the forward end portion 41*a* of the front end face 41 is cut substantially parallel to the diametrical direction of the target 4. Cutting the forward end portion 41*a* makes it possible to position the whole front end face 41 on the front side of the target 4, i.e., on the x-ray emitting window 32 side.

Operations of the x-ray tube 1 will now be explained.

Figure 4:
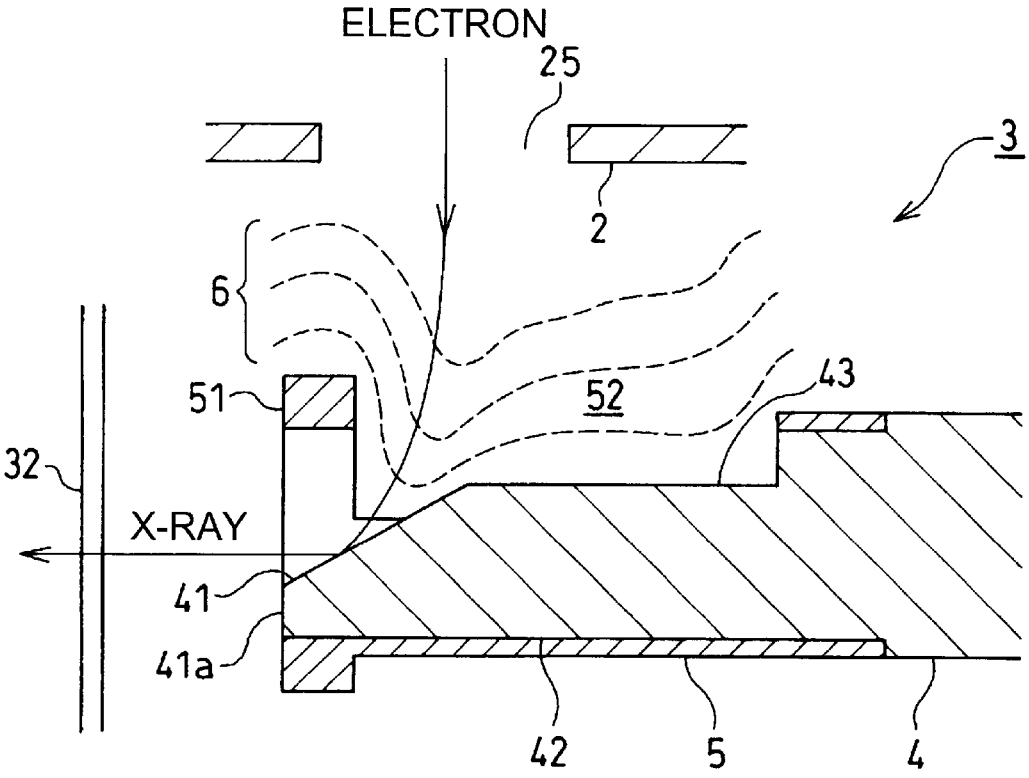
FIG. 4 is an explanatory view of operations of the x-ray tube.

FIG. 4 shows an explanatory view of operations of the x-ray tube. As shown in FIG. 4, if a positive high voltage is applied to the target 4 and hood electrode 5, then the target 4 and hood electrode 5 attain a positive high potential with reference to the peripheral part of the opening 25 of the electron gun portion 2, whereby an electric field is formed in the space between the electron gun portion 2 and the target 4 and hood electrode 5. While equipotential lines 6 of this electric field are formed along the axial direction (sidewise in FIG. 4), they are in a state drawn toward the target 4 in the vicinity of the electron passage port 52.

Also, since the part of the tip portion 42 of the target 4 exposed from the electron passage port 52 is cut off, the equipotential lines 6 are in a state drawn toward the flat face 43 of the target 4 from the electron passage port 52.

Further, since the forward end position of the front end face 41 of the target 4 is formed with the greater diameter portion 51, the equipotential lines 6 are formed on the electron gun portion 2 side (on the upper side in FIG. 4) in the vicinity of the outer periphery of the greater diameter portion 51, and are in a state strongly drawn toward the front end face 41 (on the lower side in FIG. 4) in the vicinity of the electron passage port 52. Namely, the electric field in the vicinity of the electron passage port 52 through which electrons pass is in a state greatly inclined toward the x-ray emitting window 32.

If electrons are emitted from the electron gun portion 2 in a state where such an electric field is formed, then the electrons are converged by the focus grid electrode 24 and the like and enter the x-ray generating portion 3 by way of the opening 25. Subsequently, passing positions on the front end side of the electron passage port 52, the electrons are made incident on the front end face 41.

Here, since the equipotential lines 6 are in a tilted state (state tilted downward to the right in FIG. 4) as being drawn to the front end face 41 in the area where the electrons pass through the electron passage port 52, the electrons are made incident on the front end face 41 while being bent from the vicinity of the electron passage port 52 toward the front end of the target 4, i.e., toward the x-ray emitting window 32. Consequently, the electron incident position is located near the x-ray emitting window 32 on the front end face 41.

Also, the electrons are made incident on the front end face 41 at a position near the center axis of the target 4. In order for the electrons to be incident on the target 4 at a position which is near the x-ray emitting window 32 and is in the vicinity of the center axis of the target 4, it will be sufficient if the target 4 is positioned near the x-ray emitting window 32 and so forth.

Since x-rays are generated when electrons are incident on the front end face 41, the distance between the x-ray generating position and the x-ray emitting window 32 can be shortened.

Also, since the x-ray generating position is substantially on the center axis of the target 4, x-rays forwardly expanding with substantially equal angles in individual directions such as upward, downward, leftward, and rightward directions from the x-ray emitting window 32 whose center is positioned in the center axis would be obtained.

As in the foregoing, since the electron passage port 52 is widened on the opposite side in the x-ray emitting direction, the x-ray tube 1 in accordance with this embodiment can bend the locus of electrons emitted from the electron gun portion 2 toward the x-ray emitting direction, so that the electrons are made incident on the front end face 41 at a position near the x-ray emitting window. Consequently, the distance between the x-ray generating position and the x-ray emitting window can be shortened.

Also, in the case where this x-ray tube 1 is used for irradiating an object to be inspected with x-rays and picking up its magnified penetration image with an image pickup tube, so as to inspect the state of the object to be inspected, the distance from the x-ray generating point to the object to be measured can be shortened. Consequently, the magnification rate of the picked-up image can be enhanced, so as to improve the accuracy of inspection.

Further, since the electrons are made incident on the target 4 in the vicinity of its center axis, x-rays expanding with substantially equal angles forwardly from the x-ray emitting window 32 can be obtained. Consequently, it becomes easier to handle the x-rays emitted from the x-ray tube 1.

Second Embodiment

The x-ray tube in accordance with a second embodiment will now be explained.

Figure 5:
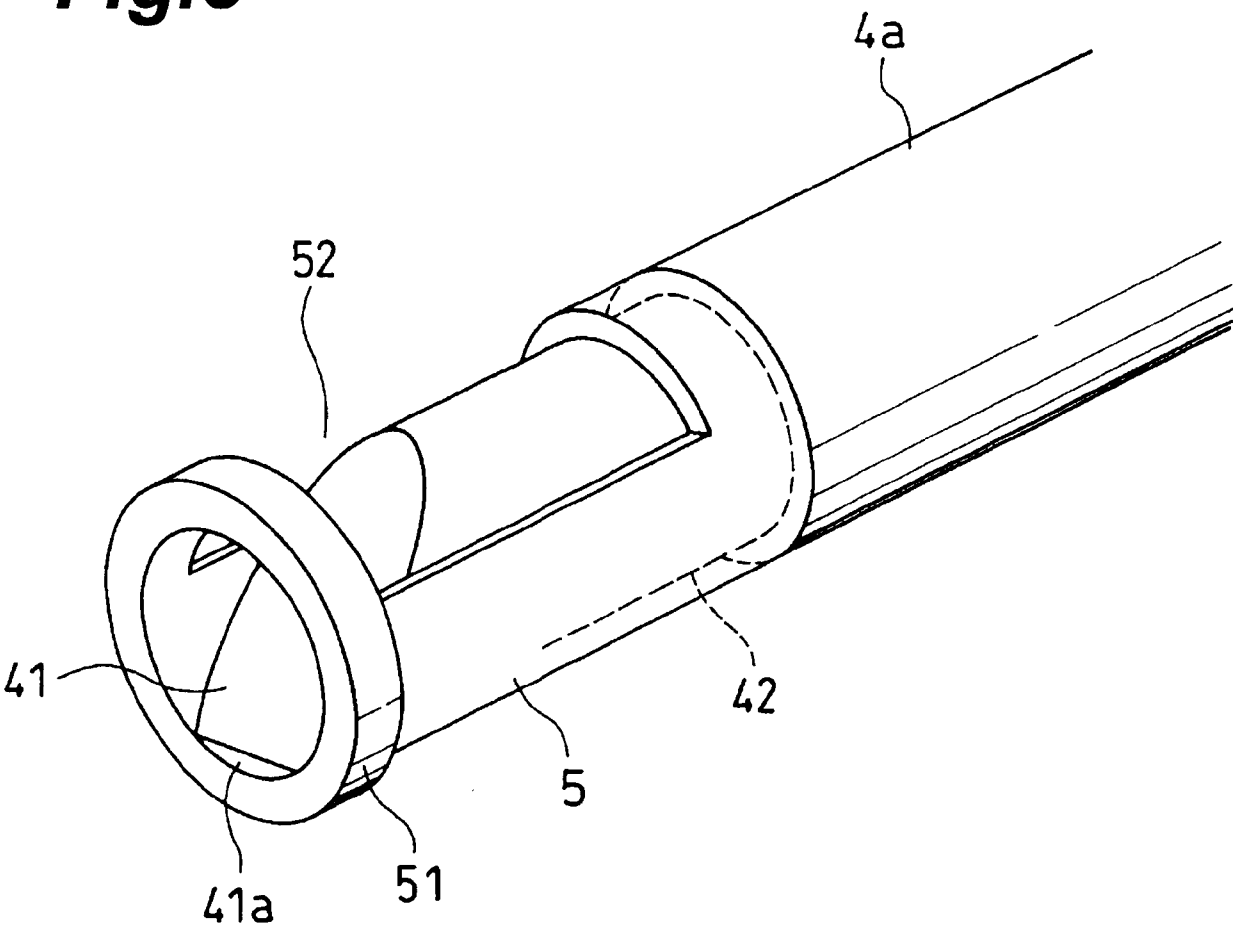
FIG. 5 is an explanatory view of the x-ray tube in accordance with a second embodiment.

FIG. 5 is an explanatory view of the x-ray tube in accordance with this embodiment. The x-ray tube in accordance with this embodiment is configured substantially similar to the x-ray tube 1 in accordance with the first embodiment and differs therefrom only in the form of its target 4*a*.

In the target 4a of the x-ray tube, as shown in FIG. 5, a tilted front end face 41 is formed at the front end of a tip portion 42 having a smaller diameter, but no flat face 43 (see FIG. 3) is formed at the peripheral face of the tip portion 42. Such an x-ray tube also yields operations and effects substantially similar to those of the x-ray tube 1 in accordance with the first embodiment.

Figure 6:
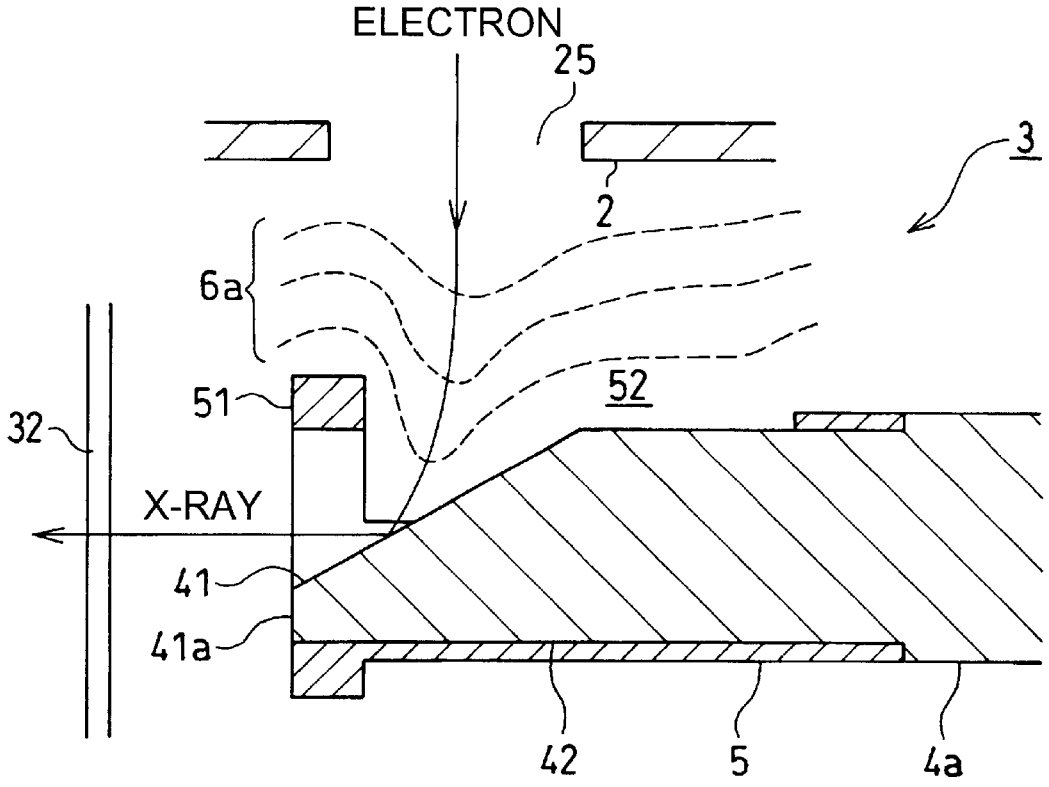
FIG. 6 is an explanatory view of operations of the x-ray tube in accordance with the second embodiment.

FIG. 6 shows an explanatory view of operations of the x-ray tube in accordance with this embodiment.

As shown in FIG. 6, if a positive high voltage is applied to the target 4*a* and hood electrode 5, then an electric field is formed in the space between the electron gun portion 2 and the target 4*a* and hood electrode 5. While equipotential lines 6*a* of this electric field are formed along the axial direction (sidewise in FIG. 6), they are in a state drawn toward the target 4*a* in the vicinity of the electron passage port 52. Also, since the forward end position of the front end face 41 of the target 4*a* is formed with a greater diameter portion 51, the equipotential lines 6*a* are formed on the electron gun portion 2 side (on the upper side in FIG. 6) in the vicinity of the outer periphery of the greater diameter portion 51, and are in a state strongly drawn to the front end face 41 (on the lower side in FIG. 6) in the vicinity of the electron passage port 52. Namely, the electric field in the vicinity of the electron passage port 52 through which electrons pass is in a state greatly inclined toward the x-ray emitting window 32.

However, unlike the target 4 of the first embodiment, the target 4*a* is not formed with the flat face 43, whereby the equipotential lines 6*a* have a gradient smaller than that of the equipotential lines 6 shown in FIG. 4 at positions where electrons pass.

If electrons are emitted from the electron gun portion 2 in a state where such an electric field is formed, then the electrons are converged by the focus grid electrode and the like and enter the x-ray generating portion 3 by way of the opening 25. Subsequently, passing positions on the front end side of the electron passage port 52, the electrons are made incident on the front end face 41.

Here, since the equipotential lines 6*a* are in a tilted state (state tilted downward to the right in FIG. 6) as being drawn to the front end face 41 in the area where the electrons pass through the electron passage port 52, the electrons are made incident on the front end face 41 while being bent from the vicinity of the electron passage port 52 toward the front end of the target 4*a*, i.e., toward the x-ray emitting window 32. Consequently, the electron incident position is located near the x-ray emitting window 32 on the front end face 41. Also, the electrons are made incident on the front end face 41 at a position near the center axis of the target 4*a*.

Since x-rays are generated when electrons are incident on the front end face 41, the distance between the x-ray generating position and the x-ray emitting window 32 can be shortened. Also, since the x-ray generating position is substantially on the center axis of the target 4*a*, x-rays forwardly expanding with substantially equal angles in individual directions such as upward, downward, leftward, and rightward directions from the x-ray emitting window 32 whose center is positioned in the center axis would be obtained.

As in the foregoing, the x-ray tube in accordance with this embodiment yields an effect that the distance between the x-ray generating position and the x-ray emitting window 32 can be shortened, substantially as with the x-ray tube 1 in accordance with the first embodiment. Also, since the target 4*a* has a simple structure, the x-ray tube in accordance with this embodiment yields an effect that it can be made easily.

Also, in the case where the x-ray tube in accordance with this embodiment is used for irradiating an object to be inspected with x-rays and picking up its magnified penetration image with an image pickup tube, so as to inspect the state of the object to be inspected, the distance from the x-ray generating point to the object to be measured can be shortened. Consequently, the magnification rate of the picked-up image can be enhanced, so as to improve the accuracy of inspection.

Further, since the electrons are made incident on the target 4*a* in the vicinity of its center axis, x-rays expanding with substantially equal angles forwardly from the x-ray emitting window 32 can be obtained. Consequently, it becomes easier to handle the x-rays emitted from the x-ray tube 1.

Third Embodiment

The x-ray tube in accordance with a third embodiment will now be explained.

Figure 7:
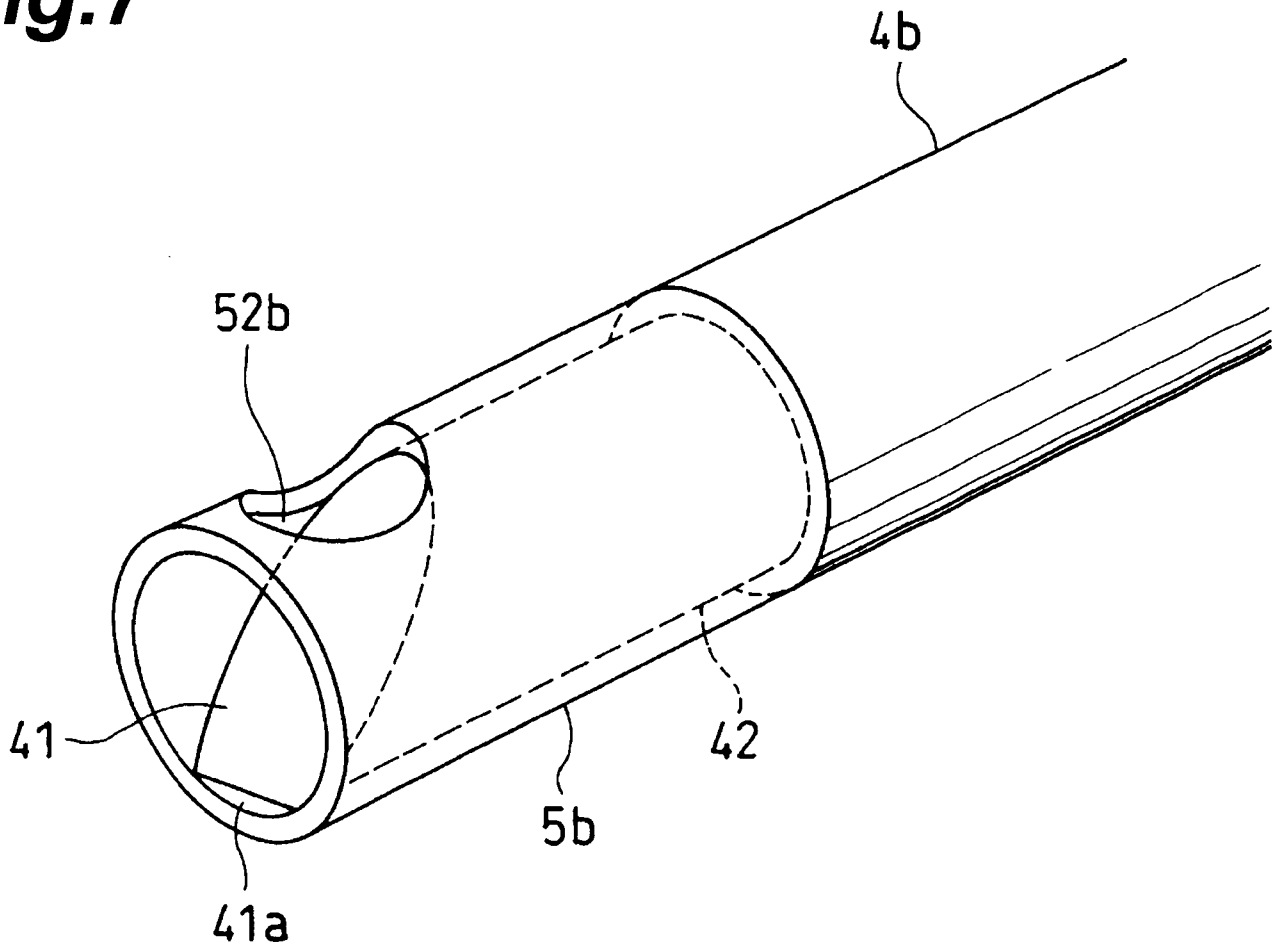
FIG. 7 is an explanatory view of the x-ray tube in accordance with a third embodiment.

FIG. 7 is an explanatory view of the x-ray tube in accordance with this embodiment. The x-ray tube in accordance with this embodiment is configured substantially similar to the x-ray tube in accordance with the second embodiment and differs therefrom only in the form of its hood electrode 5*b*.

As shown in FIG. 7, the hood electrode 5*b* of the x-ray tube is formed like a simple tube with its tip portion formed with no greater diameter portion 51 (see FIG. 5). The peripheral face of the hood electrode 5*b* is formed with an electron passage port 52*b*. The electron passage port 52*b* is a circular hole formed from the side portion of the hood electrode 5*b*. The opening form of the electron passage port 52*b* may also be a long hole extending in the axial direction of the hood electrode 5*b*. Such an x-ray tube also yields operations and effects substantially similar to those of the x-ray tubes in accordance with the first and second embodiments.

Figure 8:
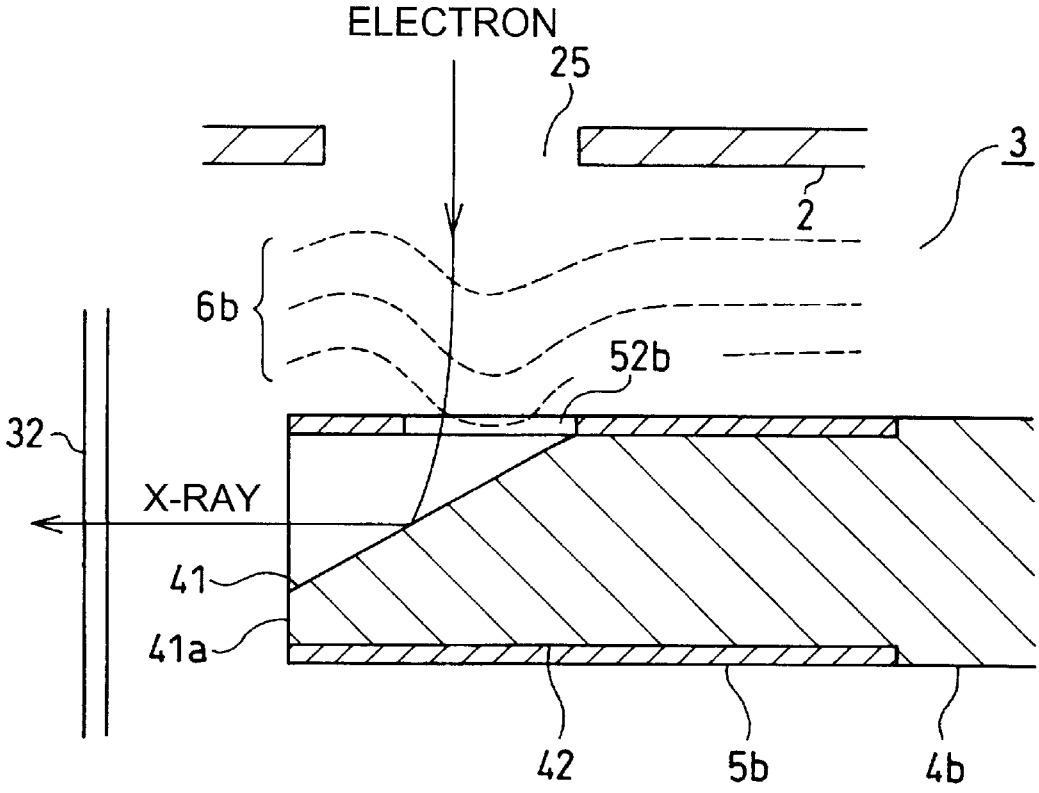
FIG. 8 is an explanatory view of operations of the x-ray tube in accordance with the third embodiment.

FIG. 8 shows an explanatory view of operations of the x-ray tube in accordance with this embodiment.

As shown in FIG. 8, if a positive high voltage is applied to the target 4*b* and hood electrode 5*b*, then an electric field is formed in the space between the electron gun portion 2 and the target 4*b* and hood electrode 5*b*. While equipotential lines 6*b* of this electric field are formed along the axial direction (sidewise in FIG. 8), they are in a state drawn toward the target 4*b* in the vicinity of the electron passage port 52*b*. Also, since the electron passage port 52*b* opens into the peripheral face of the hood electrode 5*b*, the equipotential lines 6*b* are in a state drawn toward the center position of the electron passage port 52*b*. Namely, the electric field in the vicinity of the electron passage port 52*b* through which electrons pass is in a state greatly inclined toward the x-ray emitting window 32.

If electrons are emitted from the electron gun portion 2 in a state where such an electric field is formed, then the electrons are converged by the focus grid electrode and the like and enter the x-ray generating portion 3 by way of the opening 25. Subsequently, passing positions on the front end side of the electron passage port 52*b*, the electrons are made incident on the front end face 41.

Here, since the equipotential lines 6*b* are in a state tilted toward the center position of the electron passage port 52*b* (state tilted downward to the right in FIG. 8) in the area where the electrons pass through the electron passage port 52*b*, the electrons are made incident on the front end face 41 while being bent from the vicinity of the electron passage port 52*b* toward the front end of the target 4*b*, i.e., toward the x-ray emitting window 32. Consequently, the electron incident position is located near the x-ray emitting window 32 on the front end face 41.

Also, the electrons are made incident on the front end face 41 at a position near the center axis of the target 4*b*.

Since x-rays are generated when electrons are incident on the front end face 41, the distance between the x-ray generating position and the x-ray emitting window 32 can be shortened. Also, since the x-ray generating position is substantially on the center axis of the target 4*b*, x-rays forwardly expanding with substantially equal angles in individual directions such as upward, downward, leftward, and rightward directions from the x-ray emitting window 32 whose center is positioned in the center axis would be obtained.

As in the foregoing, the x-ray tube in accordance with this embodiment yields an effect that the distance between the x-ray generating position and the x-ray emitting window 32 can be shortened, substantially as with the x-ray tubes in accordance with the first and second embodiments. Also, since the hood electrode 5*b* has a simple structure, the x-ray tube in accordance with this embodiment yields an effect that it can be made easily.

Also, in the case where the x-ray tube in accordance with this embodiment is used for irradiating an object to be inspected with x-rays and picking up its magnified penetration image with an image pickup tube, so as to inspect the state of the object to be inspected, the distance from the x-ray generating point to the object to be measured can be shortened. Consequently, the magnification rate of the picked-up image can be enhanced, so as to improve the accuracy of inspection.

Further, since the electrons are made incident on the target 4*b* in the vicinity of its center axis, x-rays expanding with substantially equal angles forwardly from the x-ray emitting window 32 can be obtained. Consequently, it becomes easier to handle the x-rays emitted from the x-ray tube 1.

Fourth Embodiment

The x-ray tube in accordance with a fourth embodiment will now be explained.

Figure 9:
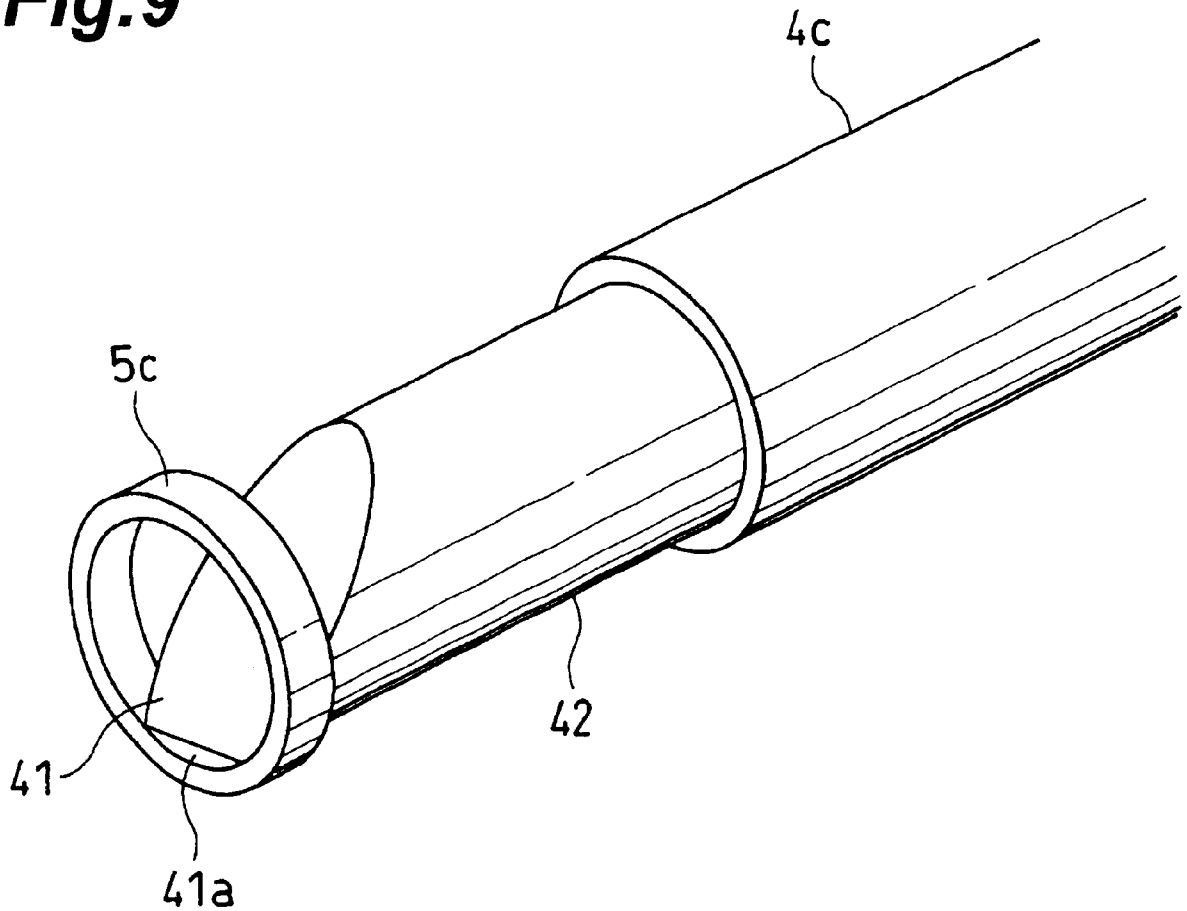
FIG. 9 is an explanatory view of the x-ray tube in accordance with a fourth embodiment.
Figure 10:
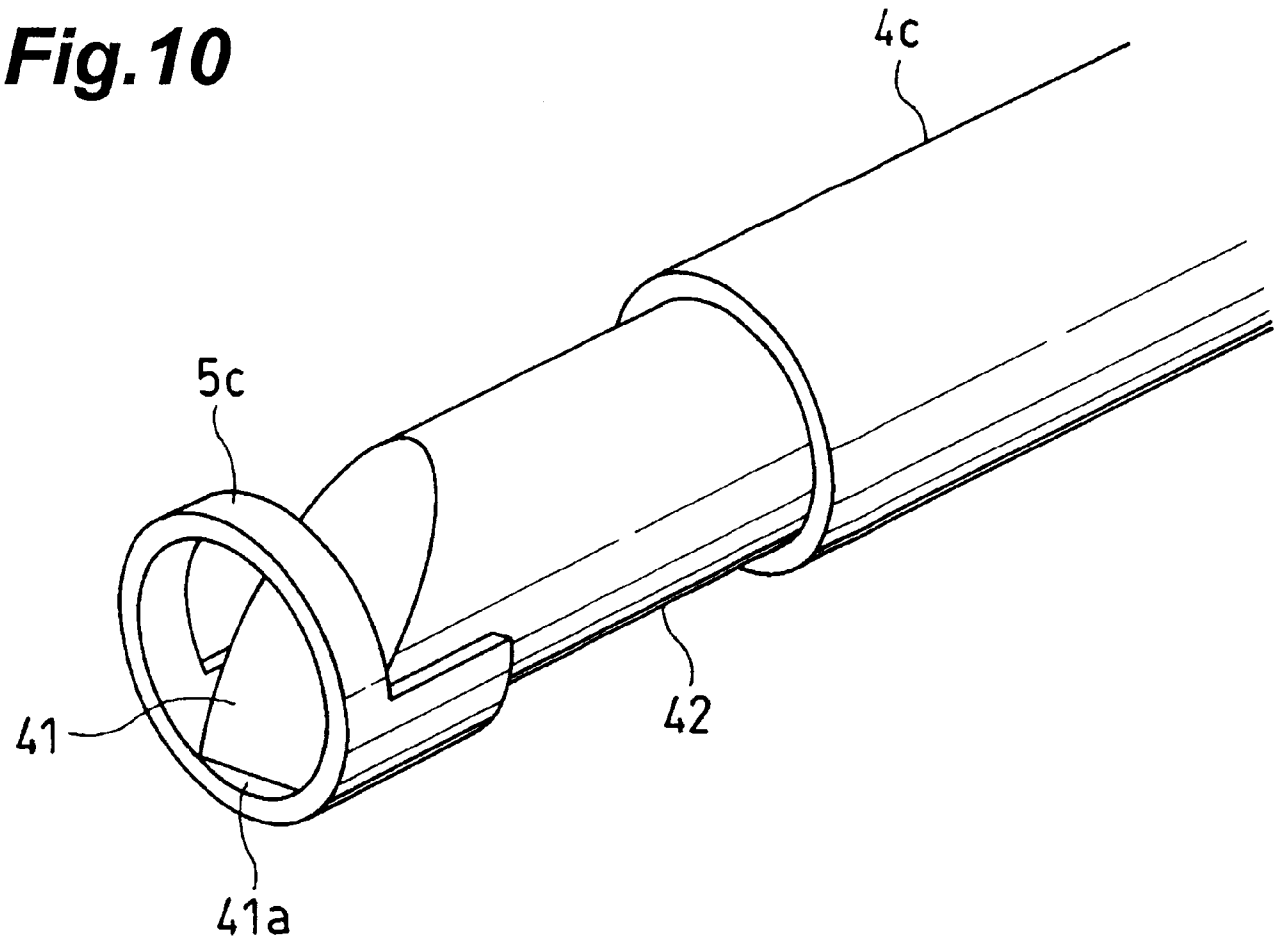
FIG. 10 is an explanatory view of the x-ray tube in accordance with the fourth embodiment.

FIGS. 9 and 10 are explanatory views of the x-ray tube in accordance with this embodiment. The x-ray tube in accordance with this embodiment is configured substantially similar to the x-ray tube in accordance with the second embodiment and differs therefrom only in that, as its hood electrode 5*c*, an annular one is used.

As shown in FIG. 9, the target 4*c* of the x-ray tube has a form identical to that of the target 4*a* of the x-ray tube in accordance with the second embodiment. The hood electrode 5*c* is attached to the forward end position of the tip portion 42 of the target 4*c*. The hood electrode 5*c* is a ring body made of a metal having an inside diameter substantially identical to the outside diameter of the tip portion 42 of the target 4*c*. Also, the hood electrode 5*c* has such a length in its axial direction that at least a part of the front end face 41 is exposed at the side portion of the target 4*c* when attached to the tip portion 42 of the target 4*c*.

Also, a part of the peripheral face of the hood electrode 5*c* may be elongated in the axial direction as shown in FIG. 10. In this case, the inner peripheral face of the hood electrode 5*c* has a larger area, thereby increasing the region coming into close contact with the outer periphery of the tip portion 42 of the target 4*c*. As a consequence, the hood electrode 5*c* can be attached accurately and easily.

Here, in the x-ray tube in accordance with this embodiment, there may be a case where the tip portion 42 of the target 4*c* does not have a diameter smaller than that of the other portion.

Figure 11:
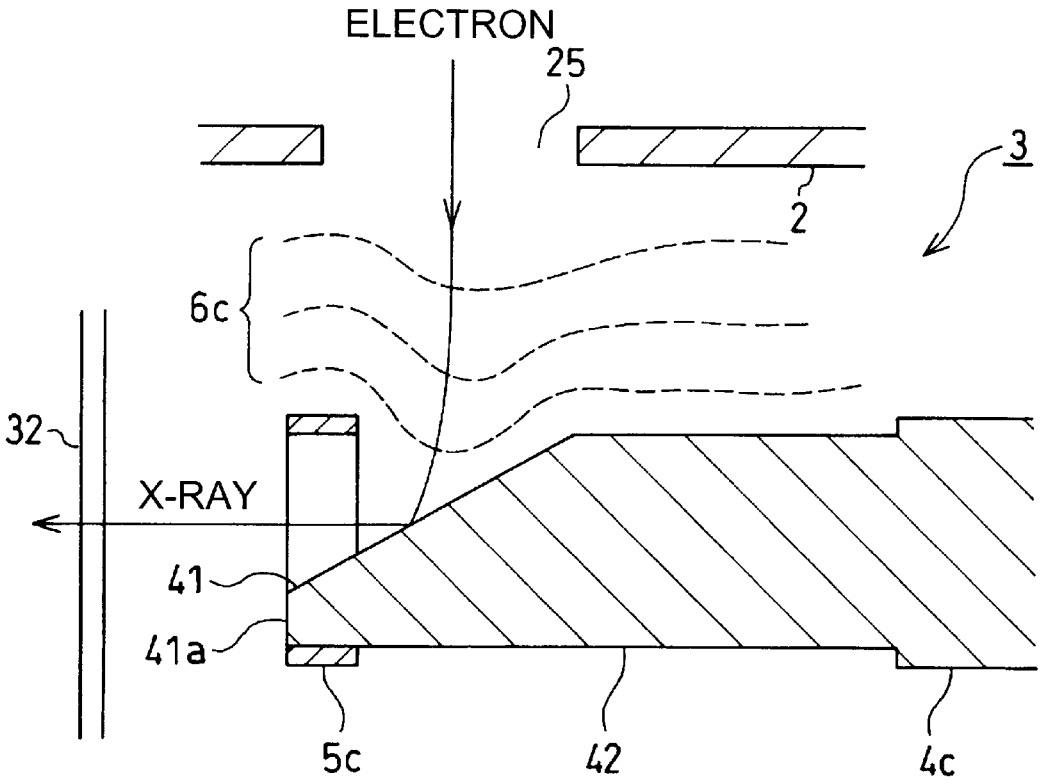
FIG. 11 is an explanatory view of operations of the x-ray tube in accordance with the fourth embodiment.
Figure 12:
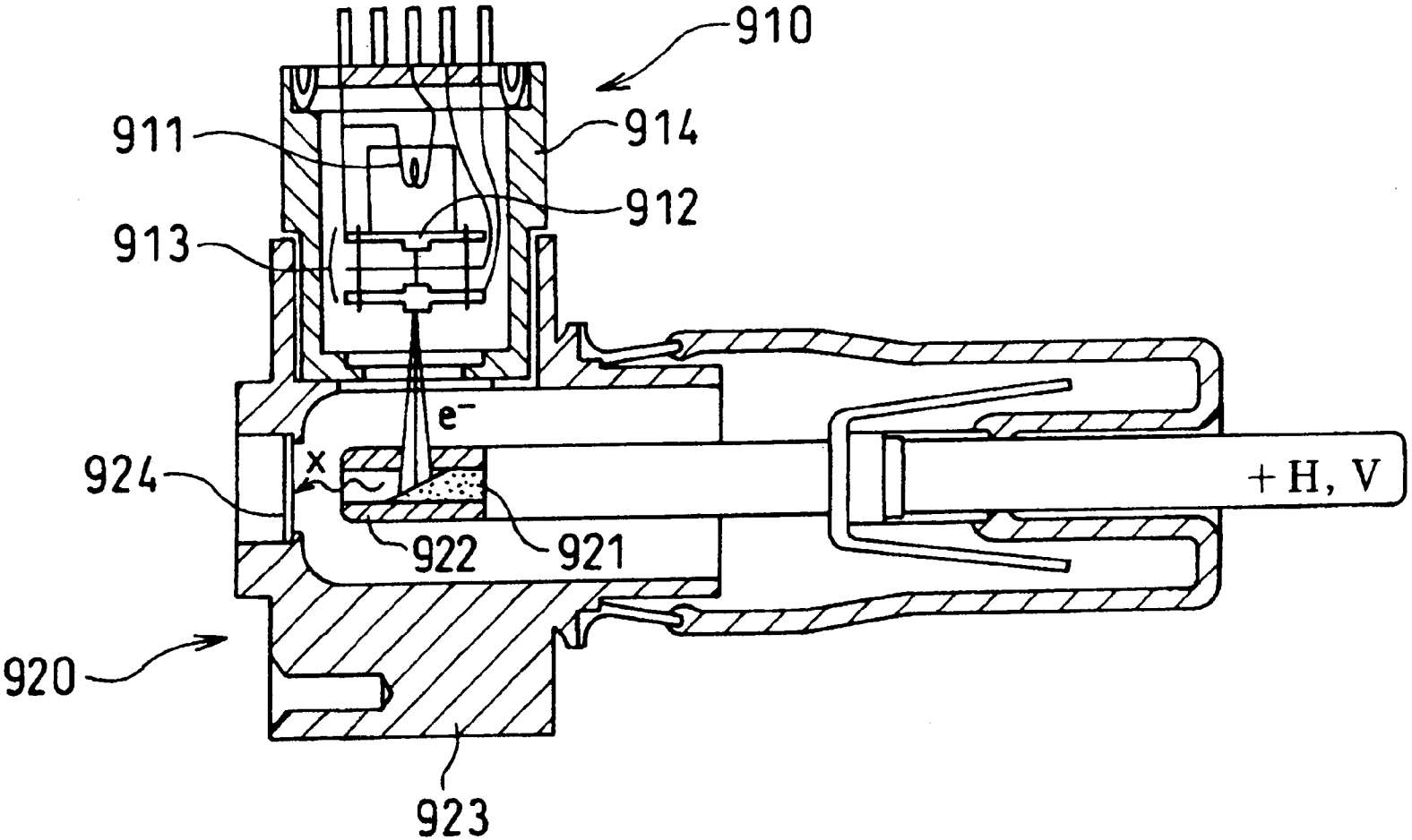
Fig.12 RELATED ART
FIG. 12 is an explanatory view of a conventional x-ray tube.
Figure 13:
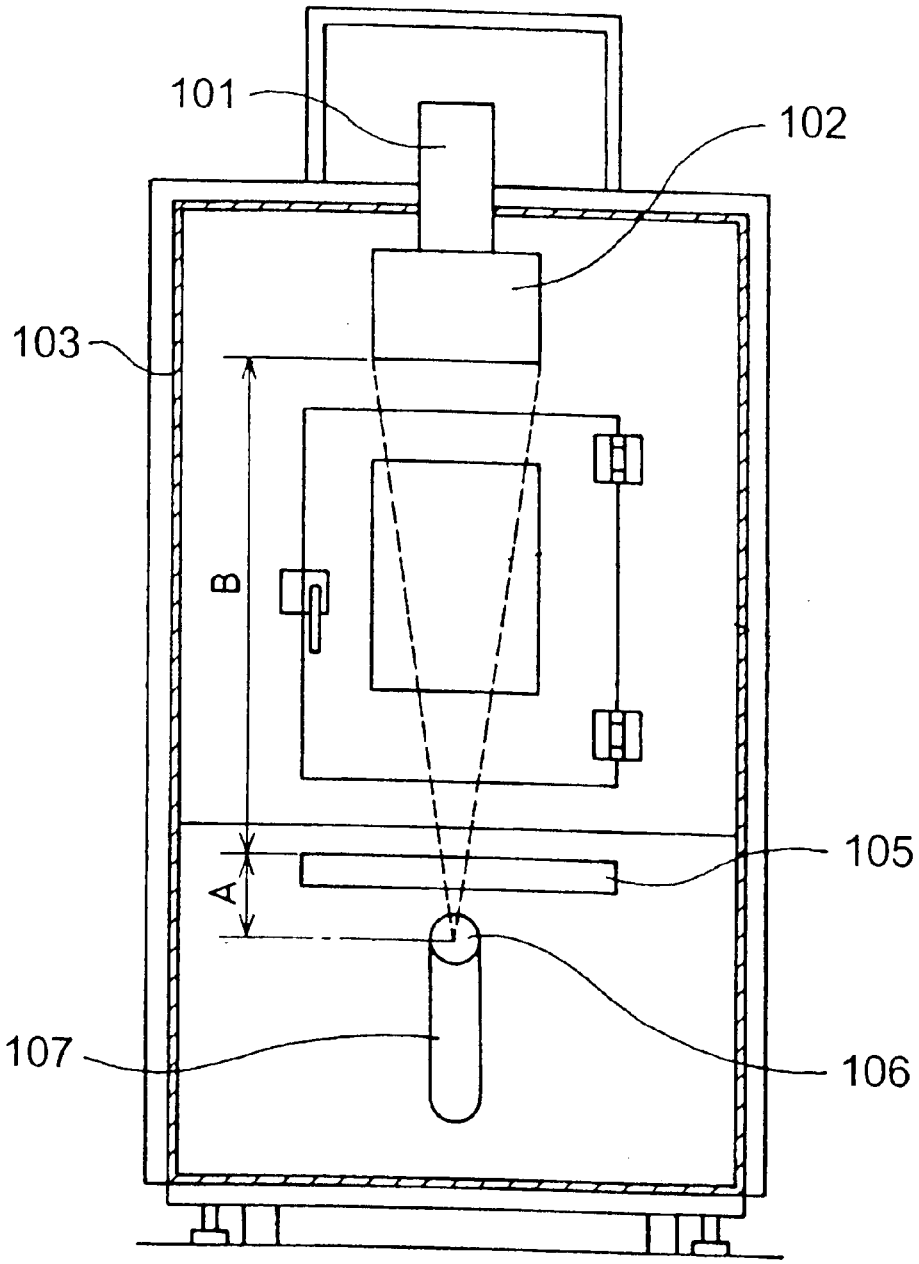
Fig.13 RELATED ART
FIG. 13 is an explanatory view of an x-ray inspection apparatus.

FIG. 11 shows an explanatory view of operations of the x-ray tube in accordance with this embodiment.

As shown in FIG. 11, if a positive high voltage is applied to the target 4*c* and hood electrode 5*c*, then an electric field is formed in the space between the electron gun portion 2 and the target 4*c* and hood electrode 5*c*. Though equipotential lines 6*c* of this electric field are formed along the axial direction (sidewise in FIG. 11), they are in a state drawn toward the target 4*c* in the vicinity of the front end face 41. Also, since the hood electrode 5*c* is disposed at the forward end position of the front end face 41 of the target 4*c*, the equipotential lines 6*c* are formed on the electron gun portion 2 side (on the upper side in FIG. 11) in the vicinity of the outer periphery of the hood electrode 5*c*, and are in a state strongly drawn toward the front end face 41 (on the lower side in FIG. 11) in the vicinity of the front end face 41. Namely, the electric field in the area where electrons pass is in a state greatly inclined toward the x-ray emitting window 32.

If electrons are emitted from the electron gun portion 2 in a state where such an electric field is formed, then the electrons are converged by the focus grid electrode and the like and enter the x-ray generating portion 3 by way of the opening 25. Subsequently, passing behind the hood electrode 5*c*, the electrons are made incident on the front end face 41.

Here, since the equipotential lines 6*c* are in a tilted state (state tilted downward to the right in FIG. 11) as being drawn to the front end face 41 in the area behind the hood electrode 5*c*, the electrons are made incident on the front end face 41 while being bent toward the x-ray emitting window 32. Consequently, the electron incident position is located near the x-ray emitting window 32 on the front end face 41.

Also, the electrons are made incident on the front end face 41 at a position near the center axis of the target 4*c*.

Since x-rays are generated when electrons are incident on the front end face 41, the distance between the x-ray generating position and the x-ray emitting window 32 can be shortened. Also, since the x-ray generating position is substantially on the center axis of the target 4*c*, x-rays forwardly expanding with substantially equal angles in individual directions such as upward, downward, leftward, and rightward directions from the x-ray emitting window 32 whose center is positioned in the center axis would be obtained.

As in the foregoing, the x-ray tube in accordance with this embodiment yields an effect that the distance between the x-ray generating position and the x-ray emitting window 32 can be shortened, substantially as with the x-ray tubes in accordance with the first to third embodiments. Also, since the hood electrode 5*c* has a simple structure, the x-ray tube in accordance with this embodiment yields an effect that it can be made easily.

Also, in the case where the x-ray tube in accordance with this embodiment is used for irradiating an object to be inspected with x-rays and picking up its magnified penetration image with an image pickup tube, so as to inspect the state of the object to be inspected, the distance from the x-ray generating point to the object to be measured can be shortened. Consequently, the magnification rate of the picked-up image can be enhanced, so as to improve the accuracy of inspection.

Further, since the electrons are made incident on the target 4*c* in the vicinity of its center axis, x-rays expanding at substantially equal angles forwardly from the x-ray emitting window 32 can be obtained. Consequently, it becomes easier to handle the x-rays emitted from the x-ray tube 1.

As explained in the foregoing, the present invention yields the following effects.

Namely, since the electron passage port is formed so as to widen on the opposite side in the x-ray emitting direction, electrons can be made incident on the front end face of the target at a position near the x-ray emitting window. Therefore, the distance between the x-ray generating position and the x-ray emitting window can be shortened. As a consequence, when employed as an x-ray source of an x-ray inspection apparatus, the present invention can shorten the distance from the x-ray generating point to the object to be measured, so as to increase the magnification rate of picked-up images, thereby improving the accuracy of inspection.

Also, when the hood electrode is made annular and disposed at a tip of the target, the electric field in the area where electrons pass inclines toward the x-ray emitting window, whereby the electrons can be made incident on the front end face of the target at a position near the x-ray emitting window. Therefore, the distance between the x-ray generating position and the x-ray emitting window can be shortened. As a consequence, when employed as an x-ray source of an x-ray inspection apparatus, the present invention can shorten the distance from the x-ray generating point to the object to be measured, so as to increase the magnification rate of picked-up images, thereby improving the accuracy in inspection.

Further, when electrons are made incident on the target in the vicinity of its center axis, x-rays expanding with substantially equal angles forwardly from the x-ray emitting window can be obtained. As a consequence, x-rays can be handled easily.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An x-ray tube comprising:

an electron gun for emitting an electron;

a target for receiving said electron emitted from said electron gun at a front end face and generating an x-ray;

an x-ray emitting window, disposed in front of said front end face of said target, for emitting said x-ray; and a hood electrode, formed as a tubular body attached to a tip portion of said target, having a peripheral face provided with an electron passage port for passing said electron therethrough, said electron passage port widening more on a side opposite from said x-ray emitting window than on said x-ray emitting window side with respect to a position intersecting an extension of said electron gun in an electron emitting direction.

2. An x-ray tube according to claim 1, wherein, of said tip portion of said target, a part exposed from said electron passage port is cut off.

3. An x-ray tube according to claim 1, wherein said electron is made incident onto a center axis of said front end face of said target.

4. An x-ray tube comprising:

an electron gun for emitting an electron;

a target for receiving said electron emitted from said electron gun at a front end face and generating an x-ray;

an x-ray emitting window, disposed in front of said front end face of said target t for emitting said x-ray; and a hood electrode formed as an annular body attached to a tip portion of said target, said hood electrode being disposed closer to said x-ray emitting window than is a position where said electron is made incident on said front end face.

* * * * *